US006719260B1

(12) United States Patent
Hart

(10) Patent No.: US 6,719,260 B1
(45) Date of Patent: Apr. 13, 2004

(54) APPARATUSES AND METHODS FOR HANGING FRAMES

(76) Inventor: Hoyt E. Hart, P.O. Box 2011, Corrales, NM (US) 87048

( * ) Notice: Subject to any disclaimer, the term of this patent is extended or adjusted under 35 U.S.C. 154(b) by 0 days.

(21) Appl. No.: 09/816,056

(22) Filed: Mar. 22, 2001

Related U.S. Application Data

(60) Provisional application No. 60/191,282, filed on Mar. 22, 2000.

(51) Int. Cl.[7] ..... A47G 1/16

(52) U.S. Cl. ..... 248/479; 248/466; 248/475.1; 248/489

(58) Field of Search ..... 248/466, 467, 248/475.1, 479, 489, 493

(56) References Cited

U.S. PATENT DOCUMENTS

| | | | | | |
|---|---|---|---|---|---|
| 3,226,065 | A | * | 12/1965 | Smith | 248/32 |
| 3,529,799 | A | * | 9/1970 | Schaefer | 248/496 |
| 3,861,639 | A | * | 1/1975 | Morrill | 248/489 |
| 4,040,149 | A | * | 8/1977 | Einhorn | 248/493 |
| 4,437,639 | A | * | 3/1984 | Stein | 248/558 |
| 4,591,125 | A | | 5/1986 | Bellehumeur | 248/476 |
| 4,610,418 | A | | 9/1986 | Graham | 248/495 |
| 4,610,489 | A | | 9/1986 | Dibert, Jr. et al. | 312/227 |
| 4,641,807 | A | * | 2/1987 | Phillips | 248/480 |
| 4,655,351 | A | | 4/1987 | Walker | 211/88 |
| 4,708,552 | A | * | 11/1987 | Bustos et al. | 411/60 |
| 4,799,914 | A | | 1/1989 | Hutchinson | 446/225 |
| D302,108 | S | | 7/1989 | Fenton | D8/373 |
| 5,112,022 | A | * | 5/1992 | Cardas | 248/493 |
| 5,180,135 | A | | 1/1993 | Hindall | 248/544 |
| 5,209,449 | A | * | 5/1993 | Hart | 248/475.1 |
| 5,249,765 | A | | 10/1993 | Garcia | 248/475.1 |
| 5,328,140 | A | * | 7/1994 | Wong | 248/493 |
| 5,425,524 | A | * | 6/1995 | Messina, Jr. | 248/475.1 |
| 5,454,542 | A | * | 10/1995 | Hart | 248/494 |
| 5,605,313 | A | * | 2/1997 | Erickson et al. | 248/467 |
| 5,758,858 | A | | 6/1998 | Barnes | 248/544 |
| 5,983,467 | A | | 11/1999 | Duffy | 24/442 |
| D422,892 | S | | 4/2000 | Donovan | D8/373 |
| 6,053,468 | A | | 4/2000 | Francis | 248/475.1 |

* cited by examiner

*Primary Examiner*—Korie Chan
*Assistant Examiner*—Steven Marsh
(74) *Attorney, Agent, or Firm*—Deborah A. Peacock; Peacock, Myers & Adams, PC

(57) ABSTRACT

Apparatuses and methods for hanging frames upon mounting surfaces. A hanger, upon which a frame is hung, is securely attached to a mounting surface, such as a wall. The hanger comprises a two-level, female, mandrel slot for receiving a two-level male mandrel. Additionally, bottom-rail-supports may be used to secure the bottom of the frame to the wall to support the weight of the frame and to immobilize the frame on the wall. A spirit-level device may be used for leveling the installed frame on the apparatus prior to fixing the frame to the wall with or without bottom-rail-supports.

17 Claims, 3 Drawing Sheets

APPARATUSES AND METHODS FOR HANGING FRAMES

CROSS-REFERENCE TO RELATED APPLICATIONS

This application claims the benefit of the filing of U.S. Provisional Patent Application Ser. No. 60/191,282, entitled "Wooden-Frame Picture Frame Hanger" filed on Mar. 22, 2000, and the specification thereof is incorporated herein by reference.

BACKGROUND OF THE INVENTION

1. Field of the Invention (Technical Field)

The present invention relates to apparatuses for hanging frames upon surfaces, and methods for their use.

2. Background Art

Despite continued efforts to overcome the problem, there remains a need for an improved means for hanging wooden frames that assures the work will hang, securely, in a level position. The present invention fills this need by providing a simple, inexpensive, and easy to use apparatus and method that permits the user to quickly hang, and secure, a frame upon a wall or other vertical surface. Practicing the present invention, the user can consistently hang a wooden frame on the level, secured to the wall, in a pleasantly horizontal aspect.

British Patent No. 1,031,208 to Chan discloses a picture hanging apparatus comprising a supporting member to be attached to a wall and a separate second member, to be attached to the back of a picture frame, for engagement with the supporting member. The invention disclosed in the '208 Patent requires that a particular customized element be attached to the frame to be hung.

U.S. Pat. No. 4,228,892 to Sellera discloses an apparatus similar to the above-mentioned British patent to Chan. The '982 patent discloses an apparatus composed of two separate elements: one element to be attached to a wall, and the other specially adapted companion element necessarily attached to the frame to be hung.

U.S. Pat. No. 4,530,482 to Berinson discloses an apparatus for hanging framed pictures consisting of a lengthy resinous strip to be attached to the wall and picture mounts with sharp edges to be attached to picture frames. The sharp edges of the picture mounts are then inserted between the strip and wall to hang picture frames. The apparatus necessarily includes a specially adapted element to be attached to the frame to be hung.

U.S. Pat. No. 4,597,554 to James also describes an apparatus consisting of a matched pair of fixture members, one of which must be attached to the picture frame.

U.S. Pat. No. 4,606,526 to Rabinowitz discloses a picture frame hanging apparatus consisting of a single block having hanger projections extending laterally along at least two sides thereof for engagement with the frame to be hung.

U.S. Pat. No. 4,804,161 to Wallo describes an apparatus consisting of a base bar of substantial width having upwardly projecting prongs at opposite ends thereof which are adapted to engage a downwardly facing surface of the top moulding of the frame. The apparatus includes a horizontally elongate fastener hole and a vertically elongate fastener hole for consecutive adjustment of the horizontal and vertical position of the apparatus. The apparatus does not provide a mechanism for preventing accidental dislocation of the frame.

U.S. Pat. No. 3,955,790 to Ballin discloses a three-part apparatus consisting of a pronged base plate to be mounted to a wall, a plumb member, and a coupling member to be mounted upon a frame. The plumb member swingably rests upon a fulcrum element of the base plate to indicate when the base plate is level. The base plate may be successfully used only in conjunction with the frame-mounted coupling member, which is shaped to interlock with the base plate.

U.S. Pat. No. 4,582,288 to Ruehl describes a device for securing cables or wires to a support surface, and discloses a means for pre-driving the securing pins in a manner to allow mounting to fragile surfaces.

U.S. Pat. No. 4,712,761 to Wassell discloses a picture frame corner bracket consisting primarily of a downwardly extending corner flange for engagement with a trough extending the length of an elongated wall-mounted strip.

U.S. Pat. No. 4,437,639 to Stein describes a self-adjusting picture hanger apparatus consisting of a wall-mounted member linked to a frame-mounted member. The members rotatably coact with one another so that gravity causes the frame to seek a vertical position. Notches and indicia are provided to assist in vertically mounting the wall-mounted member.

U.S. Pat. No. 4,458,873 to Sutherland discloses a one-piece clip apparatus for use with frames having an inwardly facing channel along the upper periphery thereof.

U.S. Pat. No. 4,531,315 to Sobel describes a corner bracket for use in assembling frames incorporating universal assembly channels.

U.S. Pat. No. 5,080,317 to Letizia discloses a picture anchoring assembly utilizing a spirit level to assure the level mounting of a picture frame.

U.S. Pat. No. 3,552,708 to Hillstrom describes a picture hanging apparatus including a picture frame element having a hollow recess and a frame-mounted clip insertable into the frame recess mounting for mounting on a nail.

U.S. Pat. No. 4,220,309 to Eisen, et al. discloses a method and apparatus for positioning frame-hanging devices upon a wall to assure proper placement of the picture.

U.S. Des. Pat. No. 282,054 to Hoffman discloses an ornamental design for a picture hanging aide.

U.S. Pat. No. 5,425,524 to Messina discloses a generally planar wall member having self-alignment by a laterally centered hole with a fastener therethrough; gravity causes the wall mount member to pivot about the fastener in a pendular motion until the lower edge rests in a horizontal attitude. The '524 Patent further discloses a planar object mount and an inverted V-shaped interior. The interior is configured to mate with the chamfered side edges of the wall mount member. As the object mount member is lowered onto the wall mount member, the chamfered side edges force the object mount member rearwardly.

U.S. Pat. No. 4,591,125 to Bellehumeur discloses a picture-hanging device with a male member adapted to be rigidly secured to the back of the frame and a female member adapted to be rigidly secured to the wall. The male member includes an upper fastening flange and a resilient lower tongue. A portion of the tongue remains exposed above a slot in the female member when fully inserted such that the exposed portion is deflected outwardly to urge the lower edge of the frame toward the wall.

U.S. Pat. No. 5,209,449 to Hart discloses an apparatus and method for hanging frames on mounting surfaces. The apparatus of the invention comprises a mostly planar body with a protruding supporting rail, a bracket recess, mounting holes and two distinct means for assuring the horizontal, level, secure, mounting of the body upon the mounting surface. The means for assuring a level mounting include the use of a removable spirit level or, alternatively, alignment notches to align the body relative to a horizontal line on the mounting surface.

The frustrations inherent in hanging wooden frames with the traditional "hook and wire" methods continue to be a nearly universal experience. Even utilizing more than one hook, it is difficult to maintain a frame straight, level and secure using the traditional method. In earthquake environments, the results can be disastrous. Frames suspended by the standard hook and wire method tend to fall away from the wall at the top, resulting in unattractive gaps between the wall and the top of the frame. Moreover, it is practically impossible to align a series of frames (either vertically or horizontally) using the hook and wire system due to the variations in wire placement, and lengths and flexibility of differing wire types. This configuration also results in the framed picture's load-vector being directed down the wall providing no wall support for the hanger device. Proper frame hangers, as in the present invention, are designed to direct load-vectors into the wall to provide optimum support for the valuable framed art installed on the wall.

SUMMARY OF THE INVENTION (DISCLOSURE OF THE INVENTION)

The present invention comprises apparatuses for hanging a wooden frame on a surface as well as of methods for hanging wooden frames.

The hanger of the present invention comprises a body having a front, a back, and a top; and an attachment of the body to the target surface. In the preferred embodiment, the apparatus further comprises a recessed two-level, female, mandrel-slot for receiving into the hanger a circular, two-level, male mandrel. The attachment of the body to the target surface preferably comprises at least two openings completely penetrating the body from front to back capable of holding fasteners (e.g., screws or nails). In the preferred embodiment, two openings are countersunk to accommodate screws, and two alternate openings are recessed for headspace to accommodate nails. Preferably, the openings for the nails penetrate the body at oblique angles such that when supporting frames or other objects their load vectors are directed into the wall. The openings should have diameters corresponding to the diameters of the fasteners.

The male mandrel of the present invention, comprises a body having a front, a back, and a thickness, the thickness preferably equal to that of the first apparatus; attachment of the body to the frame; and an attachment of the body to the target surface. Preferably the thickness embodies two levels of approximately equal dimension. The attachment of the body to the frame comprises a single, countersunk, opening, centered in the male mandrel, completely penetrating the body, to accommodate a screw of appropriate size. Attachment of the body to the target surface is accomplished by slideably mating the male mandrel with the two-level female slot in the body of the hanger fastened to the target surface.

The bottom-rail-support of the present invention, comprises a body having a top, a bottom, and a thickened pedestal centered on the top of the body. Preferably the apparatus comprises two countersunk holes on either side of the thickened pedestal completely penetrating the body; and a hole centered in the thickened pedestal, with recessed headspace, completely penetrating the body, to accommodate a single nail. Preferably the total thickness of the body equals that of the hanger; an attachment of the body to the frame; and an attachment of the body to the target surface.

Another device of the present invention, necessary for practicing the invention, comprises a body having a top, a bottom, a retaining lip, an integral clip for retaining a spirit level vial, and a spirit level.

The first method of the invention comprises the steps of: (a) providing a hanger; (b) placing the hanger flush against a mounting surface; (c) inserting at least one fastener at least partially into the hanger; (d) positioning the hanger at a desired location upon the mounting surface; (e) inserting the first fastener completely through the hanger and into the mounting surface; and (f) inserting at least one additional fastener through the hanger and into the mounting surface to position it on and attach the hanger to the mounting surface. The hanger preferably embodies an elongated, female, two-level mating slot for a mating male mandrel of similar dimensions and thickness.

The second method of the invention comprises the steps of: (a) providing a mating male mandrel having dimensions and geometry matching the mating slot of the hanger; (b) inserting a screw of appropriate dimensions into the mandrel; (c) fastening the mandrel, centered, to the top reverse of the frame; and (d) orienting the flat chord of the mandrel such that it is parallel to the top of the frame.

The third method of the invention comprises the steps of: (a) providing one or more bottom-rail-supports; (b) producing pilot holes on the bottom reverse of the frame corresponding to the positions of the countersunk holes in the bottom-rail-support; (c) inserting a single nail, back to front, into the bottom-rail-support such that the nail head is recessed on the back of the body; (d) positioning the bottom-rail-support(s) on the bottom reverse of the frame; and (e) fastening the bottom-rail-support(s) to the bottom reverse of the frame with screws of appropriate dimensions.

The fourth method of the invention comprises the steps of: (a) providing a frame with mounted mating mandrel and bottom-rail-support(s); (b) slideably inserting the mating mandrel into the hanger's mating slot; (c) carefully resting the nail(s) protruding from the bottom-rail-support(s) against the mounting surface; (d) placing the spirit level device on top of the frame; (e) holding the bottom-rail-support nail(s) away from the mounting surface; (f) rotating the frame until it is level; (g) allowing the bottom-rail-support nail(s) to again rest against the mounting surface; (h) checking the level a second time; (i) pushing the bottom-rail-support nail(s) into and through the mounting surface; and (j) removing the spirit level device.

An object of the present invention is to provide a simple, inexpensive means and method for consistently hanging wooden frames straight and level, immobilized on the mounting surface.

Another object of the present invention is to provide an apparatus for hanging wooden frames that is easy to use.

Another object of the present invention is to provide an apparatus for hanging wooden frames that is inexpensively manufactured.

Another object of the present invention is to provide a means and method for hanging wooden frames that secures the frame flush against the wall or other surface.

It is another object of the present invention to provide a means and method for hanging multiple wooden frames in horizontal alignment.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate various embodiments of the present invention and, together with the description, serve to explain the principle of the invention. The drawings are only for the purpose of illustrating a preferred embodiment of the invention and are not to be construed as limiting the invention.

DESCRIPTION OF THE PREFERRED EMBODIMENTS (BEST MODES FOR CARRYING OUT THE INVENTION)

The apparatuses of the present invention are embodied in three primary parts integral to practicing the invention, per se, and a fourth part for leveling the object to be hung.

The three parts or devices comprise a simple, one-piece frame-positioning bracket to be installed on a mounting surface such as a wall; a frame-mounted male connecting mandrel to be fastened, centered, on the top reverse of object to hung; and a bottom-rail-support to be fastened to the bottom reverse of the object to be hung. The fourth device is a spirit level equipped part for leveling the object prior to final installation on the mounting surface. The apparatus is particularly suited for use with wooden picture frames, or the like, although by utilizing adapter devices commonly known in the art the apparatus may be practiced satisfactorily with a wide variety of frame types and artifacts. The design and configurations of the apparatus permit the user to consistently mount frames upon walls in a straight and level manner and flush against the wall. The apparatus of the invention permits the user easily to utilize a plurality of the apparatuses to hang numbers of frames in horizontal and/or vertical alignment, while assuring each frame retains its level position upon the wall. The apparatuses may be any practicable size; thus, the apparatuses may be produced in a variety of sizes.

Reference is made to FIGS. 1–11, which illustrate the preferred apparatus of the present invention. The apparatus includes a hanger body 1, a mating mandrel 5, a bottom-rail-support 8, and a spirit level support device 14. All of the apparatuses are made of injection-molded plastic or any other inexpensive, durable material. The material of the hanger body preferably is somewhat elastic, such that hanger body 1 generally is quite stiff, but with some resilient flexibility in response to focused loading. Hanger body 1 is substantially planar, with the exception of certain recessed and other features later described herein. Hanger body 1 and mating mandrel 5 preferably are made of the same material. Bottom-rail-support 8 and spirit level device 14 are preferably made of softer, less expensive material.

Figure 9:
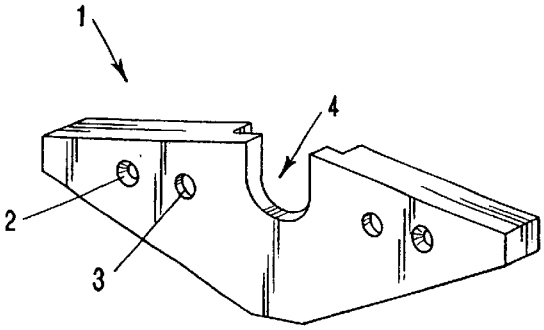
FIG. 9 is a perspective view of the front surface of the preferred hanger embodiment of FIG. 1.
Figure 10:
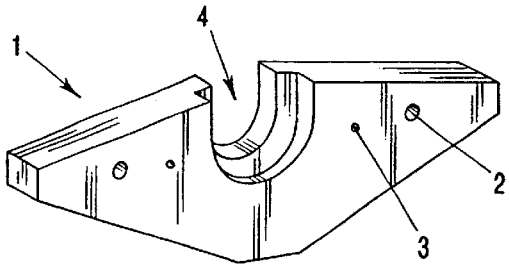
FIG. 10 is a perspective view of the back surface of the preferred hanger embodiment of FIG. 1.

As best illustrated in FIGS. 9 and 10, hanger body 1 preferably is generally trapezoidal in shape when viewed from the front or back. Other shapes (e.g. rectangular, square, triangular, etc.) may also be used.

Figure 3:
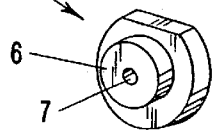
FIG. 3 is a perspective view of the front of the male mandrel of the present invention.
Figure 4:
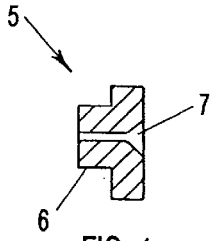
FIG. 4 is a cross-sectional side view of the male mandrel of FIG. 3.
Figure 5:
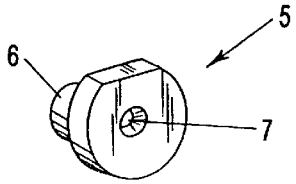
FIG. 5 is a perspective view of the back of the male mandrel of FIG. 3.
Figure 6:
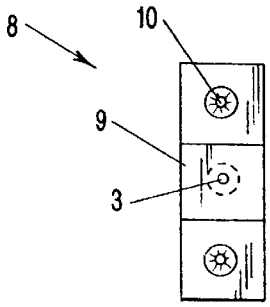
FIG. 6 is a plan view of the top, upward facing, surfaces of the bottom-rail support of the present invention.
Figure 7:
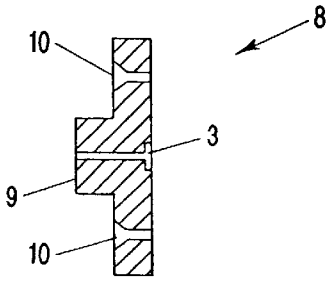
FIG. 7 is a cross-sectional side view of the bottom-rail support of FIG. 6.

As best illustrated in FIGS. 3, 4 and 5, the mating mandrel 5 is stepped and generally circular in shape with a chord intersecting the larger diameter, as best illustrated in FIGS. 3 and 5, to insure the mating mandrel 5 is not exposed above the top of the frame. The stepped mating mandrel 5 mates with the stepped mating slot 4 best illustrated in FIGS. 9 and 10.

Figure 11:
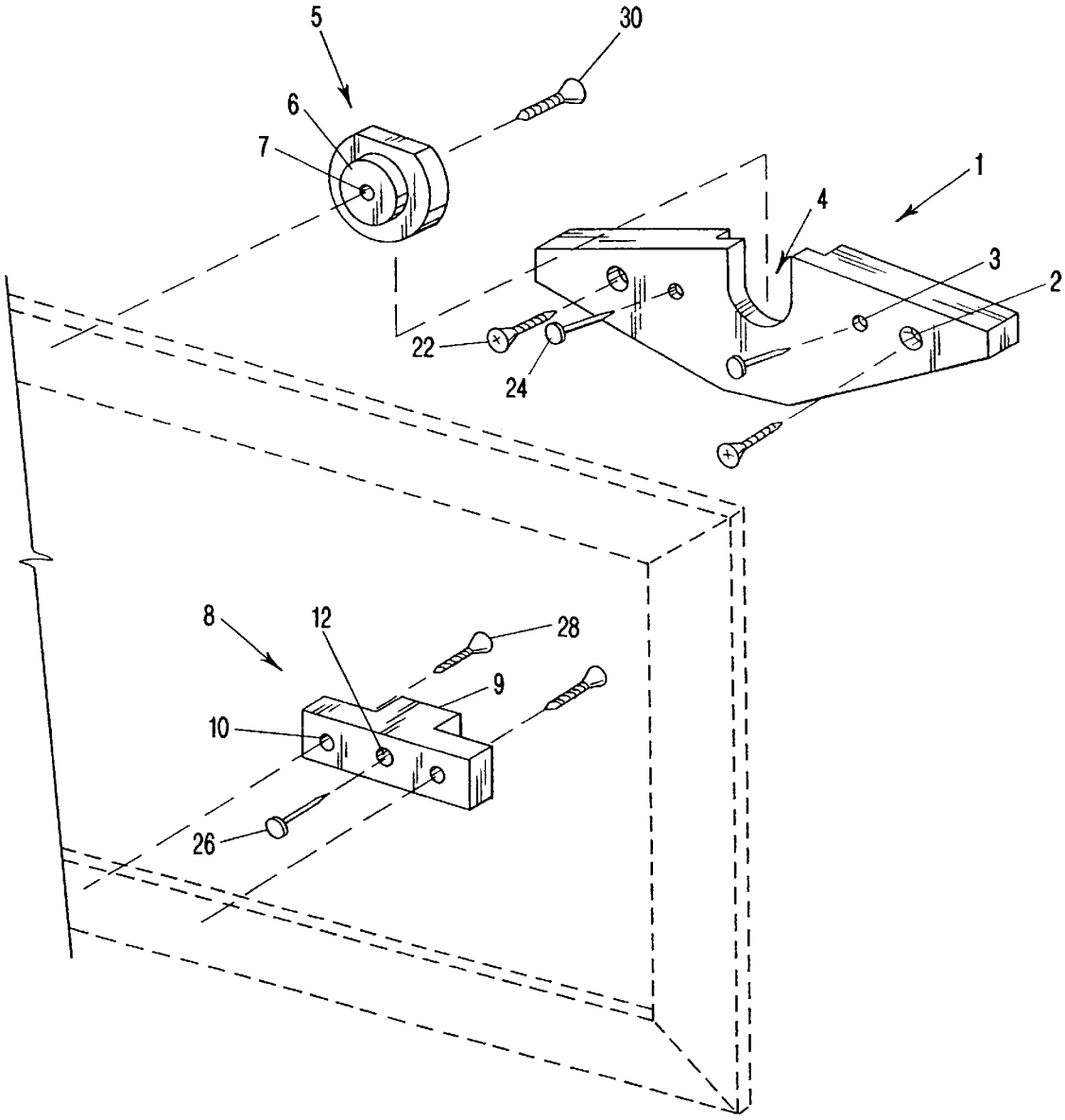
FIG. 11 comprises perspective views of the apparatus of the present invention, showing placement of the various fasteners, with respect to the reverse of a picture frame and the mounting surface.

As best illustrated in FIG. 11, the bottom-rail-support 8 is generally rectangular in shape with a raised pedestal 9 centered on the top of the bottom-rail-support body 8. The bottom of the bottom-rail-support 8 is flat to facilitate fastening to the reverse of a frame.

Figure 8:
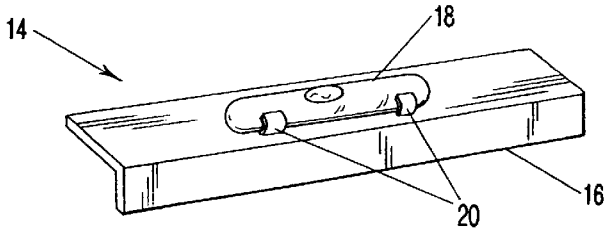
FIG. 8 is a perspective view of the spirit level and leveling device of the present invention.

As best illustrated in FIG. 8, the leveling device 14 is a generally flat, elongated bar with a lip 16 to facilitate placement and retention on the top of a frame, providing a clip 20 or other means of retaining a spirit leveling vial 18. The leveling device can vary in length, width and thickness without impairing practice of the other apparatuses.

Figure 1:
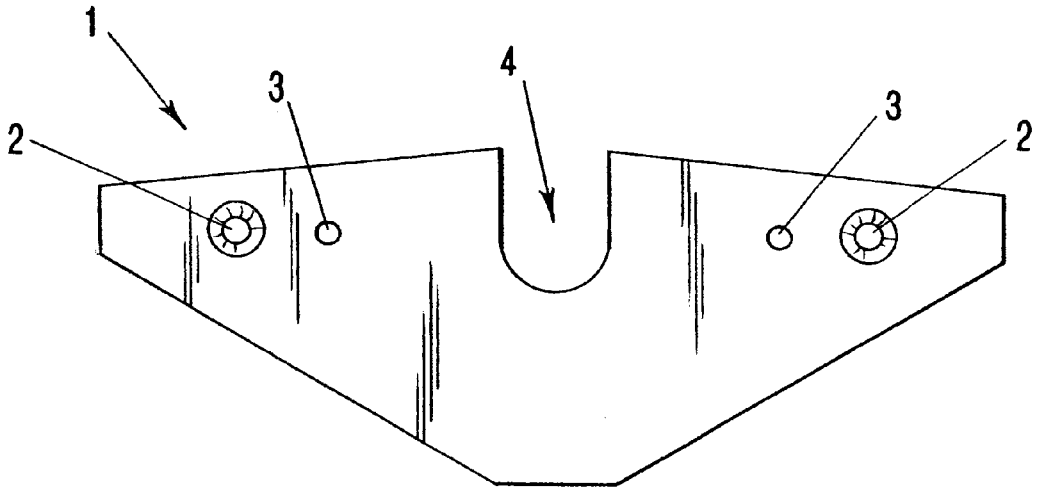
FIG. 1 is a plan view of the front, outward facing, plane of the hanger of the present invention.
Figure 2:
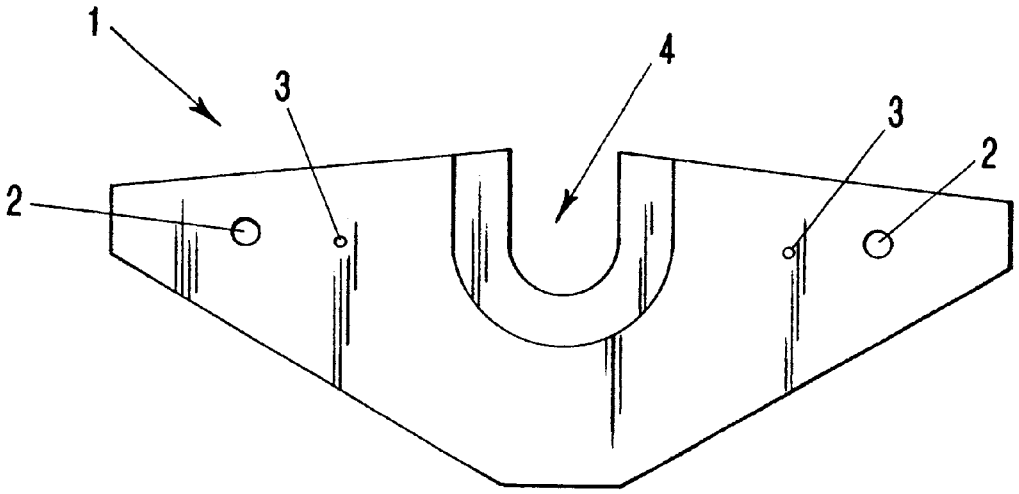
FIG. 2 is a plan view of the back, wall facing, plane of the preferred embodiment of the hanger of FIG. 1.

Brief reference is made to FIGS. 2 and 10, showing the back of hanger body 1. The back is substantially smooth and flat, which characteristic permits the hanger to be mounted flush against a wall or other flat mounting media.

FIGS. 1, 2, 9, 10 and 11 show various mounting holes 2, 3 in the hanger body. Mounting holes 2 are countersunk, small diameter, holes formed to penetrate completely straight through the hanger body 1 from front to back, to facilitate fastening the hanger body 1 to a mounting surface with flat-head screws of appropriate dimensions driven into various types of anchors commonly available. Alternatively, particularly when the mounting surface is sheetrock in composition, mounting holes 3 are recessed to facilitate fastening the hanger body 1 with flat-head nails of appropriate dimension such that the nail heads will not protrude above the surface of hanger body 1.

Specific reference is made to FIGS. 1, 2, 9, 10 and 11. It is noted that mounting holes 3 penetrate hanger body 1 at oblique angles downward from front to back such that the holes on the front are somewhat closer to the top of hanger body 1 than the corresponding openings on the back. This feature of the invention insures that the frames load vector is directed into the wall which forces the flat back of the hanger 1, firmly against the wall. The diameters of the mounting holes 2, 3 are preferably approximately equal to, or slightly less than the diameters of the fasteners with which the apparatus will be hung and the holes are preferably tapered to hold the fasteners firmly during mounting. These features of the apparatus allow the mounting holes 2, 3 to serve as "nail-" or "screw-keepers" which grasp and hold the nails or screws while the user hammers or turns the fasteners into the wall. In the preferred embodiment, the fasteners to be used are nails. Alternatively, screws may be used to hang the apparatus. Other means of attachment such as bolts, anchors or even strong adhesives, doublesided hook and loop, and the like, may also be used in accordance with the present invention. An advantage of the invention is, therefore, that it is easily practiced by a lone user; the apparatus' mounting holes 2, 3 hold the fasteners, thus freeing one of the user's hands to operate a hammer or screwdriver while the other hand holds the apparatus 1 in place.

The preferred method of practicing the invention is best understood with reference to FIG. 11. The hanger body 1 is placed against the wall or other mounting medium and held by hand at the desired mounting location. The mating slot 4 in the hanger body is placed such that it faces the wall or other mounting medium. The hanger is positioned approximately horizontal on the wall and slightly below the desired location of the top of the frame to be hung. The sloping shoulders shown on the upper surface of the hanger body 1 permit the user to approximate horizontal positioning of the hanger body 1 within tolerable error without using a leveling device. The user then manually inserts nails 24, or other suitable fasteners, into mounting holes 3. The "nail keeper" advantage of the invention comes into play as the snug fit between the fasteners and mounting holes 2, 3 causes the fasteners to remain within the mounting holes 2, 3 in ready position to be hammered or screwed, while the user's hands are freed to position the hanger 1 and wield tools.

Holding the apparatus 1 thus positioned with one hand, with the other hand the user hammers the nails 24 into the mounting surface such that the nail heads are recessed below the front surface of the apparatus.

Thus, secured to the wall, the hanger body 1 is ready to accept a frame for hanging. Further explanation of the hanging method follows.

Referring again specifically to FIG. 11, preparing the frame or other object for hanging is the second step. This is accomplished by placing the frame or other object to be hung face down on a padded surface so as not to damage the front of the frame or other object. Addressing the top member of the frame, the user marks the center of the frame's top member both lengthwise and widthwise. Then, using an awl or other sharp tool, the user marks the center of the frame member with a pilot hole to insure proper positioning of the screw 30, or other fastener, used to attach the male mandrel 5 to the reverse of the frame, or other object, to be hung on the hanger body 1. The mounting hole 7 in the male mandrel 5 is the exact diameter of the fastener. This facilitates attaching the male mandrel 5 to the reverse of the frame or other object to be hung.

The user then inserts the fastener 30, preferably a flat head screw of sufficient length to penetrate the frame, or other object, just short of breaking through its front surface, into the male mandrel 5 such that it mates with the countersink in the apparatus. The user then places the point of the screw 30 into the pilot hole previously made and drives it into the frame until the male mandrel 5 is firmly seated, centered, on the frame's top member.

And finally, again referring to FIG. 11, the user attaches the bottom-rail-support(s) 8 onto the reverse bottom of the frame or other object to be mounted on the hanger body 1. On smaller frames, plaques and the like, a single bottom-rail-support 8 is generally sufficient. On larger objects it is recommended that two bottom-rail-supports 8 be employed, equally spaced inward from the sides of the frame or object to be hung, at the user's discretion. Generally, the bottom-rail-support(s) may be placed anywhere on the bottom member of the frame but as close to the bottom edge as is practicable. This facilitates steadying the associated nails 26 in the bottom-rail-supports 8 while pushing them into the mounting medium during final installation of the frame or other object on the hanger body 1.

Each bottom-rail-support 8 used is fastened to the reverse bottom member of the frame or object with two small screws 28. The nail 26 associated with the bottom-rail-support 8 is inserted into the bottom of the bottom-rail-support 8 such that the nail head rests in the recess provided. With the point of the nail 26 facing outward the bottom-rail-support(s) are then fastened to the bottom of the frame or other object. It is helpful to score pilot holes in the bottom of the frame spaced to accommodate the bottom-rail-support's 8 countersunk screw holes.

The male mandrel 5 and the bottom-rail-supports 8 installed on the back of the frame or other object, the frame is ready to be installed on the hanger body 1. This is done by holding the frame in proximity to the hanger body 1 previously installed, inserting the male mandrel 5 into the mandrel slot on the hanger body 1, and lowering the frame or other object to rest on the bottom-rail-support nails, against the mounting medium.

Referring specifically to FIG. 8, the user then places the spirit level device 14, on top of the mounted frame with the lip 16 of the device placed over the back of the frame. Then, lifting the bottom of the frame slightly, to avoid nail damage to the mounting medium, the user rotates the frame, via the male mandrel 5, until the bubble is centered in the level 18 of the leveling device 14. Maintaining the level disposition of the frame or other object, the frame is again permitted to rest against the mounting medium. The user then places index and middle finger(s) on either side of the nail(s) 26, and thumbs over the nail head(s), then gently pushes the nails into and through the mounting medium. The installation is now complete.

An alternative method of practicing the invention is particularly well suited to hanging multiple frames in a horizontal or vertical line of display. Using a carpenter's level, chalk line or other conventional means, the user of the invention causes a thin horizontal or vertical line to be temporarily marked on the wall or other mounting media. Such a line should be sufficiently long to accommodate the desired number of frames at the desired horizontal or vertical spacing. The height of a horizontal line should be approximately at the desired level of the tops of the frames to be hung. Visible parts of the line after objects are hung should be erased.

It is here noted that the methodology described immediately above may have application to objects, other than frames, to be attached to a surface. The method may be practiced with nearly any device upon which another item will be attached. Likewise, the mounting surface need not be a wall, but can be any surface to which a frame or other device needs to be attached.

In all embodiments and methodologies, the order of certain of the method steps may be varied without adversely affecting the practice of the invention. The fasteners may be inserted in the mounting holes either before or after the apparatus is placed against the mounting surface; the order in which the fasteners are applied may be varied, and the like. The method claims are thus not limited to the order of steps set forth therein.

Although the invention has been described with reference to preferred embodiments, other embodiments can achieve the same results. Variations and modifications of the present invention will be obvious to those skilled in the art and it is intended to cover in the appended claims all such modifications and equivalents. The entire disclosures of all applications, patents and publications cited above, and of the corresponding application are hereby incorporated by reference.

What is claimed is:

1. An apparatus for hanging an object on a wall or other mounting surface, said apparatus comprising:

a hanger body comprising a front, a back and a stepped smooth radial slot;

a mandrel comprising a front and a back, wherein said front of said mandrel comprises at least one surface extension having a greater radius than a body of said mandrel, such that radii of said body and said extension comprise a stepped configuration engageable by said radial slot of said hanger body, said surface extension being substantially circular in shape with a chord intersecting a diameter of said circular shape;

and wherein said front of said mandrel further comprises a smooth circumference such that said mandrel is freely rotatable upon said smooth radial slot of said hanger body with minimal frictional engagement in a rotational direction;

a fastener for attaching said hanger body to the mounting surface; and a fastener for attaching said mandrel to the object.

2. The apparatus of claim 1 further comprising a support.

3. The apparatus of claim 2 wherein said support comprises at least one fastener for attaching said, support to the object.

4. The apparatus of claim 3 further comprising at least one countersunk opening completely penetrating said support for holding said fastener.

5. The apparatus of claim 1 further comprising at least one opening completely penetrating said hanger body from said front to said back for holding said fastener for attaching said hanger body to the mounting surface.

6. The apparatus of claim 4 wherein at least one of said countersunk openings penetrates said hanger body at an oblique angle.

7. The apparatus of claim 4 wherein at least one of said openings comprises a tapered, predetermined diameter corresponding to a diameter of said fastener.

8. The apparatus of claim 1 wherein said mandrel comprises an opening completely penetrating said mandrel from said front to said back of said mandrel for holding said fastener for attaching said mandrel to the object.

9. A method of hanging frames or other objects, the method comprising the steps of:

providing a hanger body with at least one fastener opening and a smooth, stepped radial slot;

placing the hanger body flush against a mounting surface;

fastening and positioning the hanger body at a desired location upon the mounting surface;

providing a mandrel having at least one surface extension wherein the surface extension comprises a greater radius than a body of the mandrel, such that radii of the body and the extension comprise a stepped configuration engageable by the smooth radial slot of the hanger body, said surface extension being substantially circular in shade with a cord intersecting a diameter of said circular shade, and wherein the surface extension comprises a smooth circumference;

positioning the mandrel on the reverse of the frame or other object;

fastening the mandrel to the frame or other object;

installing the frame or other object on the hanger body by disposing the mandrel on the hanger body;

freely rotating the frame or other object about the mandrel upon the smooth radial slot of the hanger body to obtain a desired position on the mounting surface with minimal frictional engagement between the mandrel and hanger body in the rotational direction; and fixing the frame on the mounting surface at the desired position.

10. The method of claim 9 wherein the step of fastening the hanger body comprises inserting at least one fastener, at least partially, into an opening in the hanger body.

11. The method of claim 10 further comprising the step of driving the fastener completely through the opening in the hanger body and into the mounting surface.

12. The method of claim 9 wherein the step of fastening the mandrel to the frame or other object comprises inserting a single fastener into a single opening in the mandrel.

13. The method of claim 12 further comprising the step of driving the single fastener into the frame or other object.

14. The method of claim 9 further comprising the step of providing an additional fastener for fixing the frame or other object to the mounting surface.

15. The method of claim 14 wherein the step of providing an additional fastener comprises providing a support.

16. The method of claim 15 further comprising the step of disposing the support on the frame or other object.

17. The method of claim 15 wherein the step of fixing the frame on the mounting surface at the desired position comprises using the support to fix the frame or other object to the mounting surface.

* * * * *